US005980212A

United States Patent [19]

Shen et al.

[11] Patent Number: 5,980,212

[45] **Date of Patent: *Nov. 9, 1999**

[54] ANODE-CATHODE STRUCTURE FOR ION PUMP HAVING SPECIFICALLY DETERMINED DIMENSIONS

[75] Inventors: Guo Hua Shen; Nozomu Takagi; Toshihiro Terasawa; Tsuyoshi Kotani; Hiroyuki Kinpara; Katsuji Nakajima; Hiroyuki Miho, all of Chigasaki, Japan

[73] Assignee: Nihon Shinku Gijutsu Kabushiki Kaisha, Kanagawa-ken, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/773,775

[22] Filed: Dec. 26, 1996

[30] Foreign Application Priority Data

Dec. 26, 1995 [JP] Japan ..... 7-338966

[51] Int. Cl.[6] ..... F04B 37/02; F04F 11/00; H01J 7/16

[52] U.S. Cl. ..... 417/49; 313/7

[58] Field of Search ..... 313/7, 153, 233, 313/235, 309, 310, 336, 359.1, 442, 443; 417/48, 49; 445/2, 41

[56] References Cited

U.S. PATENT DOCUMENTS 4,397,611 8/1983 Wiesner et al. ..... 417/49
4,631,002 12/1986 Pierini ..... 417/49

OTHER PUBLICATIONS

H. Hartwig et al. "A new approach for computing diode sputter–ion pump characteristics", J. Vac. Sci. Technol., vol. 11, No. 6, Nov./Dec. 1994, pp. 1154–1159.
Kimo M. Welch, "Capture Pumping Technology", 1991, pp. 65–183. (no month).

*Primary Examiner*—William Oen

[57] ABSTRACT

A sputter ion pump in which the ratio of the length L to the diameter D of each anode cell forming a multi-cell anode inserted between two cathodes is defined within a certain range, thereby increasing a critical vacuum level to be evacuated and achieving a higher exhaust speed.

12 Claims, 7 Drawing Sheets

ANODE-CATHODE STRUCTURE FOR ION PUMP HAVING SPECIFICALLY DETERMINED DIMENSIONS

BACKGROUND OF THE INVENTION

The present invention relates to an anode-cathode structure for a sputter ion pump for use in ultra-high vacuum conditions.

FIG. 1 illustrates a conventional sputter ion pump in which a multi-cell anode comprises a number of hollow cylindrical members A which are parallel with each other and disposed between two cathode plates C. The cathode plates C are subjected to sputtering by means of penning discharging, to activate the surfaces thereof, and gas molecules are adsorbed or embedded in the activated surfaces of the cathode plates C, or gas molecules are caught by the surfaces of the anode, whereby evacuation of gases may be carried out.

In another conventional anode arrangement, polygonal hollow members may be used for a multi-cell type anode. In addition, a further anode structure is also known in which a plurality of plate members are layered on each other and are provided with a number of concentric holes, and the respective plate members are maintained at an equal potential.

A sputter ion pump currently used was developed and completed in the 1970s and its exhaust region of the pump was about $10^{-3}$ Pa to $10^{-9}$ Pa. When the pump was used to attain ultra-high vacuum conditions, the sputter ion pump was used in combination with a rotary vacuum pump or an absorption pump.

Thereafter, in the 1990s, a turbo molecule pump has been widely used. Primarily, an evacuation procedure is used in which the turbo molecule pump is firstly operated to perform a coarse or rough evacuation up to $10^{-5}$ Pa. Thereafter, a sputter ion pump is operated to attain an intended vacuum level. There have been demands for a sputter ion pump with an increased attainable critical vacuum level. Specifically, a sputter ion pump is able to perform evacuation up to $10^{-10}$ Pa, and having an evacuation speed maximized in the region of $10^{-7}$ Pa to $10^{-9}$ Pa has been desired.

As a method of increasing the obtainable critical vacuum level, a conventionally known method is used in which the product of the intensity (B) of a magnetic field and the diameter (D) of each hollow cylinder of an anode is increased to increase the ionization collision frequency of cathode emission electrons. (See Journal "Vacuum", Vol. 13, No. 7, p. 230.)

Meanwhile, J. Vac. Sci. Technol., Vol. 11, No. 6 teaches that the evacuation speed of a sputter ion pump is proportional to a length (L) of an anode and a diameter (D) of the respective hollow cylinder. In general, when the performance of magnets is kept constant, the intensity of a magnetic field can be increased by decreasing the distance between the magnets. In order to decrease the distance between the magnets, the length (L) of the anode must be shortened, and as a result, the evacuation speed of the pump is reduced. If the diameter (D) of the respective anode hollow cylinder is increased to attain a higher critical vacuum level, the number of hollow cylinders in a limited range of the magnetic field is decreased, and thus the evacuation speed of the pump is reduced. Also, if the space of the magnetic field is kept constant, it is impossible to extend the length (L) of the anode. Therefore, conventional sputter ion pumps sacrifice exhaust speed in order to increase the attainable critical vacuum level.

A report disclosed in J. Vac. Sci. Technol., Vol. 11, No. 6 says that the evacuation speed is proportional to the effective length (1+0.5 δ) of an anode. However, it has been found that this relation is not satisfied within a range of a low pressure or high vacuum. In particular, when the pressure is equal to or lower than $10^{-5}$ Pa, the evacuation speed is not proportional to the effective length (1+0.5 δ) of the anode.

Thus, a conventional sputter ion pump as shown in FIG. 1 suffers because evacuation speed must be sacrificed in order to increase the attainable critical vacuum level because the number of anode hollow cylinders existing in a limited range of a magnetic field is decreased. Thus, the evacuation speed of the pump is reduced when the diameter (D) of each anode hollow cylinder is increased to decrease the limit pressure. Moreover, the length (L) of the anode cannot be enlarged when the magnetic field is kept constant.

Furthermore, the conventional sputter ion pump as shown in FIG. 1 is designed by calculating the evacuation speed $S_1$ of each anode cell (or discharging section) in accordance with following relation:

$$S_1\ Lr_a^2$$

where $r_a$ is the radius of the cell.

With a sputter ion pump having n discharging sections, therefore, the evacuation speed $S_n$ is represented as $S_n=nS_1$. However, the exhaust speed $S_o$ is actually lower than $nS_1$ because of conductance in a gap between the anode and each of two cathodes.

Consequently, in order to increase the evacuation speed of the sputter ion pump, the length (L) of the anode and the gaps ($G_1$) and ($G_2$) between the cathodes and the anode must be increased. However, when the sum of $(L)+(G_1)+(G_2)$ made larger, the intensity of the magnetic field is weakened as described above. Therefore, the conventional sputter ion pump is designed such that the length of the anode (L) is as large as possible, where that the sum of $(L)+(G_1)+(G_2)$ is kept constant. That is, all of conventional sputter ion pumps are designed so as to satisfy a condition of $(L)>(G_1)+(G_2)$.

SUMMARY OF THE INVENTION

It is, therefore an object of the invention to provide a sputter ion pump which solves the problems associate with the conventional technique and is able to increase the attainable critical vacuum level and achieve a high evacuation speed.

Another object of the invention is to provide a sputter ion pump which has an evacuation speed higher than a conventional sputter ion pump when the distance between cathodes is kept constant.

According to one aspect of the present invention, a sputter ion pump is provided comprising at least one anode having a plurality of cell members and disposed between two cathodes, wherein each anode and each of said cathodes are arranged to satisfy the following condition $$0.015 \leqq L/D \leqq 0.8$$

where L is the length of each anode cell member and D is the diameter of each anode cell member.

If the diameter D is increased and the length of the respective anode L is shortened so as to satisfy the condition $0.015 \leqq L/D \leqq 0.8$, the attainable critical vacuum level can be increased and the evacuation speed can simultaneously be increased. Specifically, it is apparent from FIGS. 8 and 9 that decreasing the length L of each anode cell member increases, the greater the evacuation speed is. With the sputter ion pump according to the present invention, the evacuation speed is high within a range where the pressure is low, because a shorter anode results in a slight decrease in the evacuation speed when the pressure is $10^{-5}$ Pa or more, while, as a practical matters, the sputter ion pump is substantially not used but a turbo molecular pump is used under a pressure of $10^{-5}$ Pa or more.

In addition, the number N of the anodes and the number n of cathodes can be selected so that n=N+1, i.e., the number of cathodes is greater by one than the number of anodes.

Further, according to the present invention, an arbitrary one of cathodes may be arranged such that both the front and back surfaces of the cathode are subjected to sputtering.

Since the length L of the anode is shortened, the number of cathodes can be increased when the magnetic field space is kept constant. In addition, the evacuation speed is multiplied when both surfaces of a cathode are subjected to sputtering.

Further, by providing an anode arrangements having two or more anode layers, the number of cathodes made of Ti material is reduced by one so that the manufacturing cost of a pump itself can be reduced.

According to another aspect of the present invention, a sputter ion pump is provided comprising at least one anode having a plurality of cell members and disposed between a pair of cathodes, wherein each anode and each of the cathodes satisfy the following condition:

$$0.01<L/(G_1+G_2)<1$$

where L is a length of each anode, $G_1$ is a distance between one of the paired cathodes and the anode, and $G_2$ is a distance between the other cathode and the anode.

DETAILED DESCRIPTION OF THE PREFERRED EMBODIMENTS

The embodiments of the present invention will now be described only by way of example with reference to FIGS. 3 to 11 of the accompanying drawings.

Figure 3:
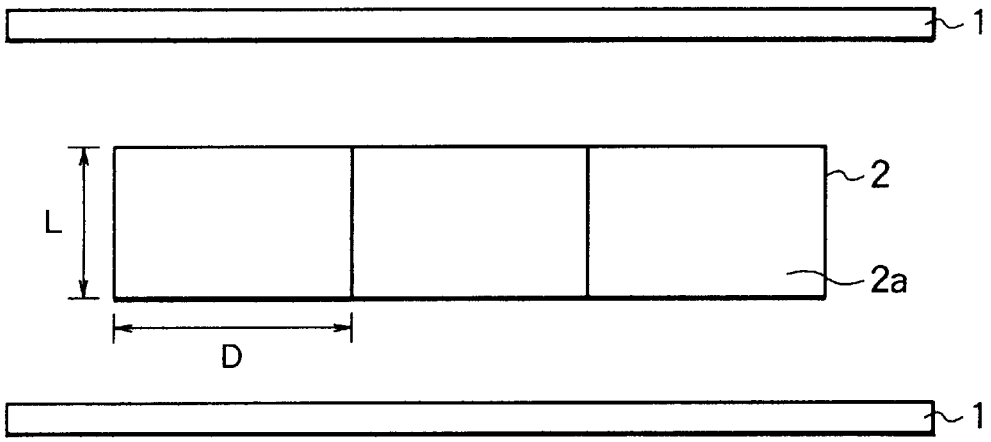
FIG. 3 is a schematic diagram showing one concept of the sputter ion pump according to the present invention.

FIG. 3 schematically shows a main part of the sputter ion pump illustrating one concept of the present invention, which comprises two cathode plates 1 and an anode 2 provided between the cathodes 2. The anode 2 is formed as a multi-cell anode in which a plurality of cylindrical members 2*a* are arranged adjacent to each other. As shown in this figure, the two cathode plates 1 and the anode 2 are positioned in relation to each other and the dimensions of thereof are determined so as to satisfy the following relation:

$$0.015\leqq L/D\leqq 0.8$$

where L is the length of the anode 2 and D is the diameter of each of the anode cell members 2*a* forming the anode 2.

Figure 4A:
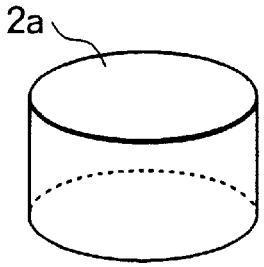
FIGS. 4A to 4D are schematic perspective views showing various examples of an anode structure applicable to the sputter ion pump of the present invention.
Figure 4B:
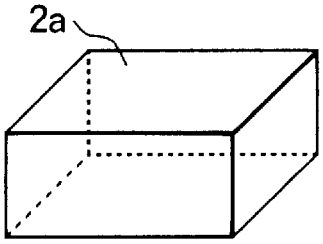
Figure 4C:
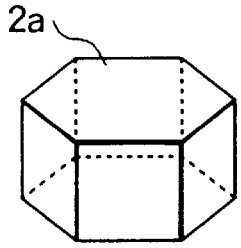
Figure 4D:
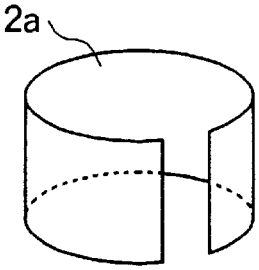

Each of the cylindrical members 2*a* forming the anode 2 may be practically realized in an appropriate shape, such as a circular cylindrical member as shown in FIG. 4A, a polygonal cylindrical member as shown in FIG. 4B or 4C, a circular cylindrical member having a vertical slit as shown in FIG. 4D.

Figure 5:
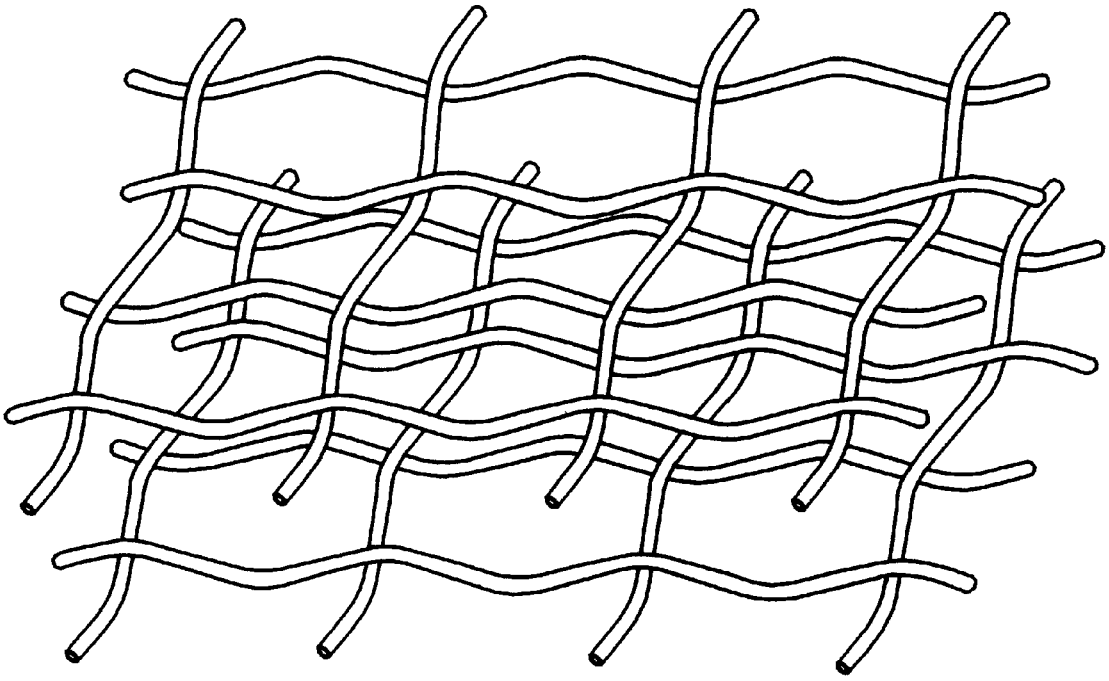
FIG. 5 is a schematic perspective view showing another example of an anode structure applicable to the sputter ion pump of the present invention.

Alternatively, the anode 2 may be formed by layering a plurality of net-like members, as shown in FIG. 5.

Figure 1:
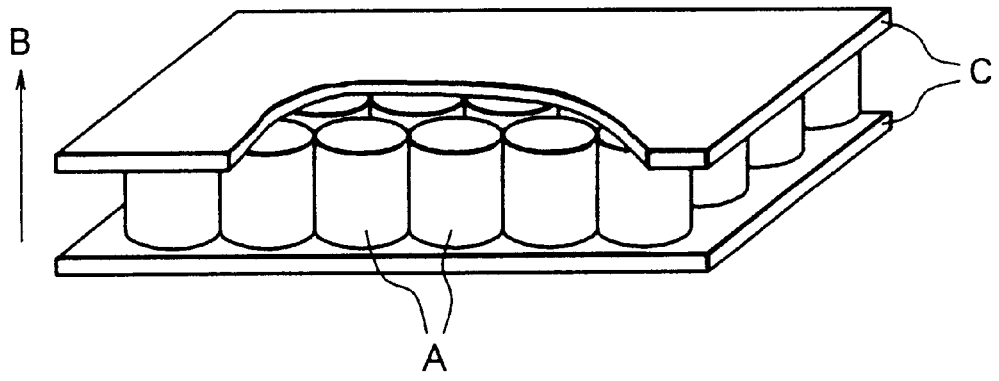
FIG. 1 PRIOR ART
FIG. 1 is a schematic perspective view showing an example of a conventional bipolar sputter ion pump.
Figure 2:
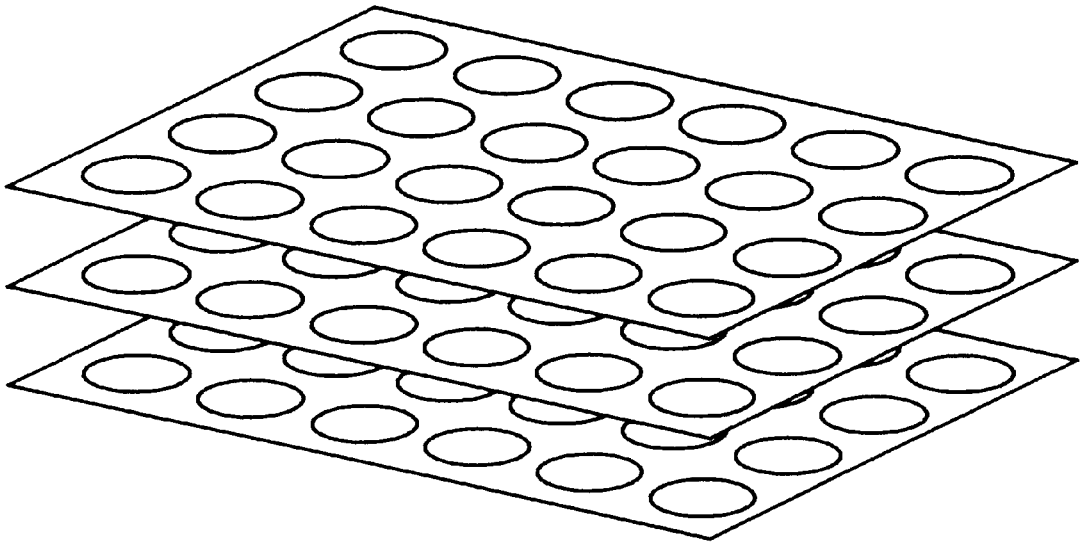
FIG. 2 PRIOR ART
FIG. 2 is a schematic perspective view showing another anode arrangement of a conventional bipolar sputter ion pump.

Further, as shown in a conventional example of FIG. 2, plate-like members having a plurality of holes may be layered on each other to form an anode. In this case, corresponding holes of the upper and lower plate-like members are positioned to be coaxial with each other.

Figure 6:
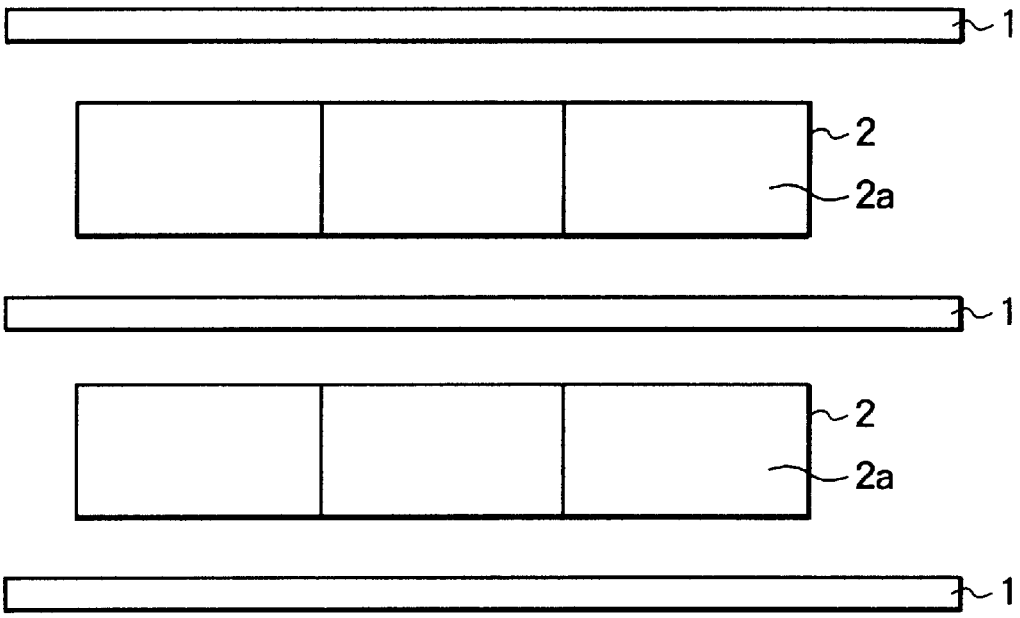
FIG. 6 is a schematic diagram showing an embodiment of the sputter ion pump of the present invention.

FIG. 6 illustrates an embodiment of the present invention in which two multi-cell anodes are layered, each consisting of a plurality of cylindrical members 2*a* arranged in parallel with each other, and cathode plates 1 are provided above and below each of the multi-cell anodes. In this case, both surfaces of the intermediate cathode plate 1 inserted between two anodes 2 are sputtered during operation. Also, the intermediate cathode plate 1 is associated with both of the upper and lower anodes 2, so that the number of cathode plates 1 as a whole can be reduced by one. This is advantageous because each of the cathode plates is formed from an expensive material.

Figure 7:
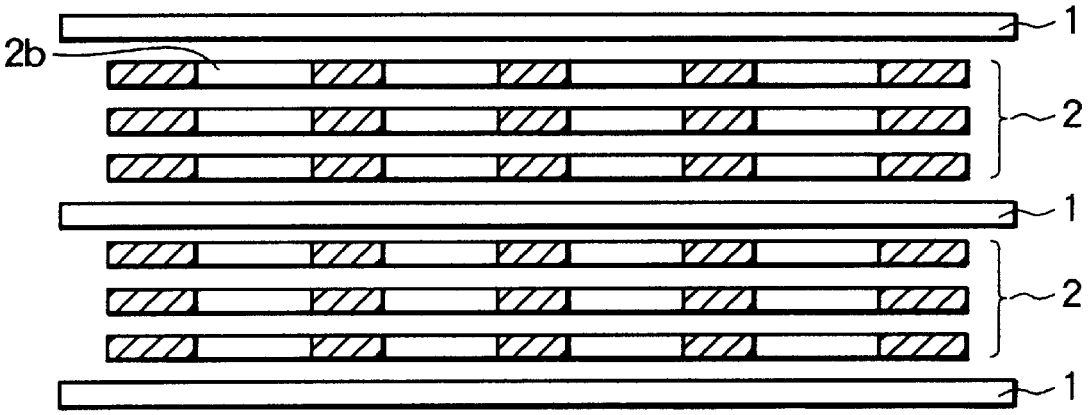
FIG. 7 is a schematic diagram showing another embodiment of the sputter ion pump of the present invention.

FIG. 7 illustrates another embodiment constructed in a two-layered structure like in FIG. 6. In this case, each of the anodes 2 consists of three plate-like members layered on each other and having a number of holes 2*b*. Corresponding holes of layered plate-like members are positioned to be coaxial with each other.

Then, in the sputter pump according to the present invention, each of cathodes 1 and each of anodes 2 are arranged so as to satisfy the relation $0.015\leqq L/D\leqq 0.8$, and as a result, the diameter D of each anode cell member 2*a* is increased while the length L of each anode is shortened. Therefore, it is possible to increase the attainable critical vacuum level which by the pump and to increase the evacuation speed.

Meanwhile, when the length L of the anode is short, electrons restricted by a magnetic field and an electric field spread into gaps between cathodes 1 and anodes 2. Since the electric voltage of each gap is lower than the voltage of each anodes 2, the electric field has a low ability to restrict electrons. In addition, since the magnetic field is relatively strong, electron clouds spread in the gaps, so that the volume of the electron clouds increases. Specifically, the electron clouds overflows from both side surfaces of each anode 2. As a result, ionization efficiency is improved. Gas molecules ionized by electron clouds having thus grown in the gaps do not perpendicularly enter into each cathode 1 but enter obliquely thereto by means of the magnetic field effect. Because to this, the sputtering efficiency with respect to the cathodes is increased, and as a result, the evacuation speed may be increased.

Figure 8:
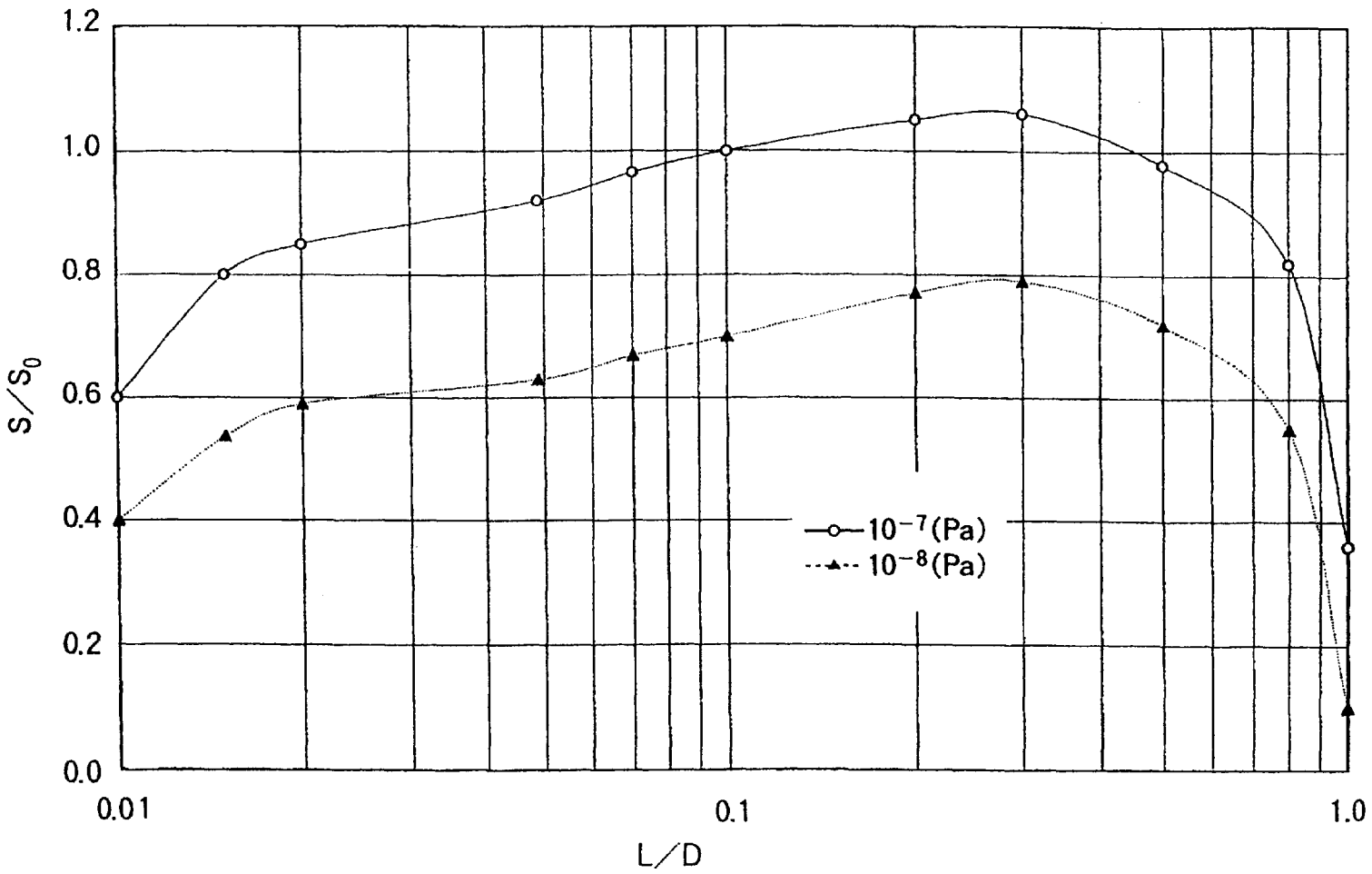
FIG. 8 is a graph of an experiment example showing a relation between the evacuation speed and the anode arrangement of the sputter ion pump of the present invention.
Figure 9:
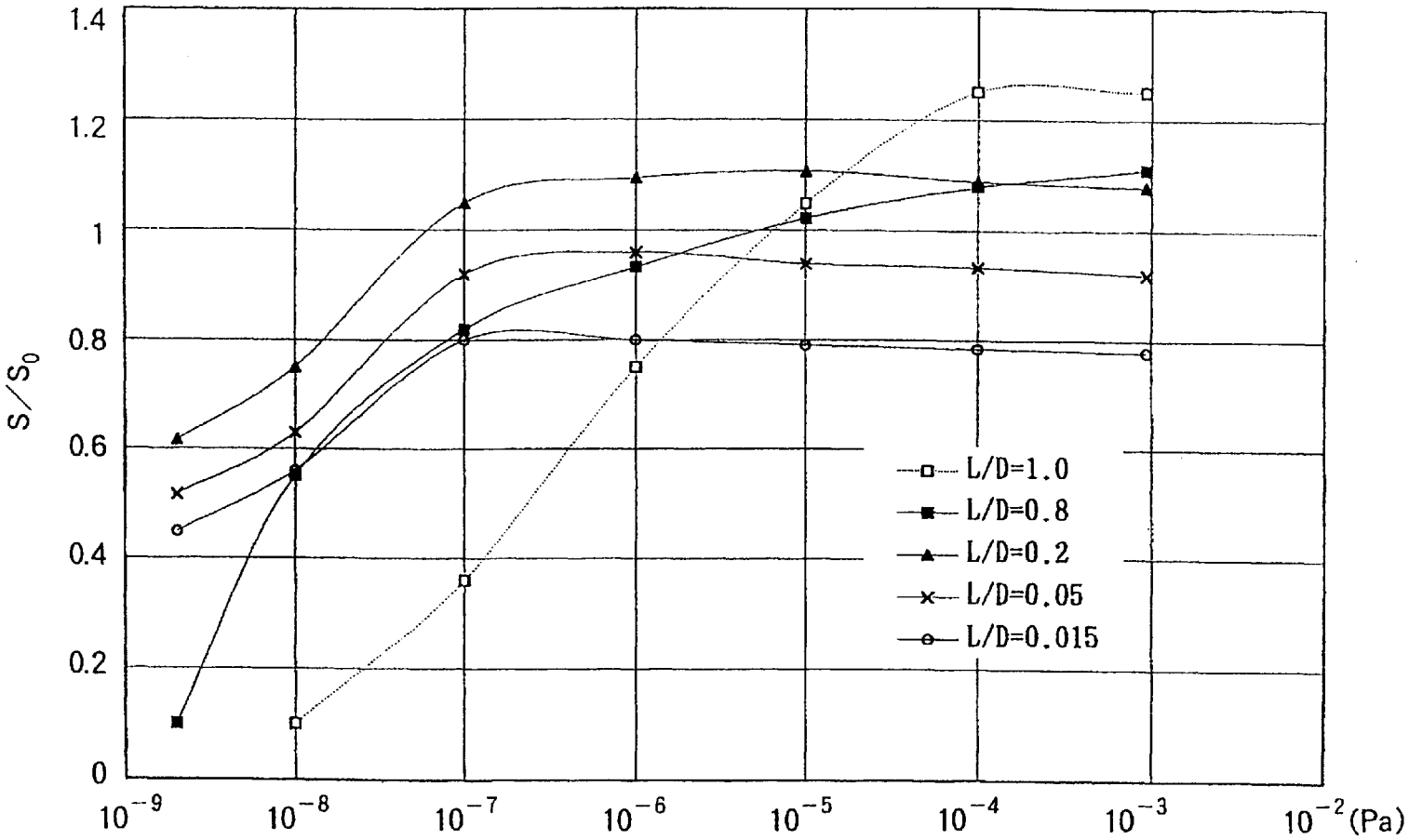
FIG. 9 is a graph showing an experiment example of the evacuation speed of the sputter ion pump of the present invention.

FIGS. 8 and 9 show an example of experimental results, and show how the exhaust speed changes according to relationship between the length of each anode and the diameter of each cathode. The longitudinal axis represents a division result obtained by dividing an exhaust speed S by an exhaustion speed $S_o$ while changing the value of L/D. The peak of $S/S_o$ can be shifted within a range of L/D=0.015 to 0.8, by appropriately setting the internal pressure and the diameter of each cylindrical member 2*a* or each hole forming part of the anodes 2.

Figure 10:
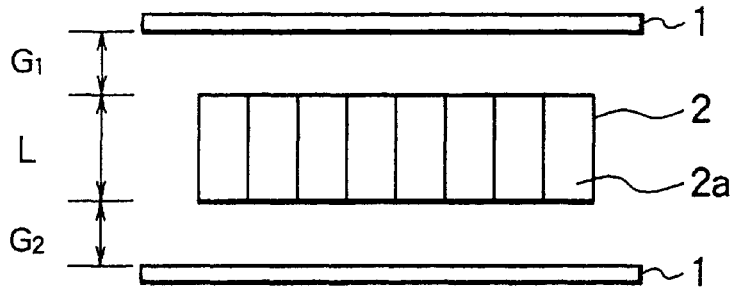
FIG. 10 is a schematic diagram showing another concept of the sputter ion pump according to the present invention.

FIG. 10 schematically shows a main part of a sputter ion pump which represents another concept of the present invention and comprises two cathode plates 1 and an anode 2 provided between the cathode plates 1. The anode 2 is formed as a multi-cell anode consisting of a number of cylindrical members 2*a* as in the case of FIG. 3.

As is shown in FIG. 10, the two cathodes 1 and the anode 2 are positioned in relation to each other and sized so as to satisfy a relation as follows while the distance between both of the cathodes 1 is maintained constant, $$0.01<L/(G_1+G_2)<1$$

where L is the length of the anode 2, $G_1$ is the distance between one of the cathodes 1 and the anode 2, and $G_2$ is the distance between the other cathode 1 and the anode 2.

More specifically, each of $G_1$ and $G_2$ is an average value of the distance between the surface of the anode 2 and the respective cathode 1.

Each of the cylindrical members 2*a* forming the anode 2 may be a circular cylindrical member as shown in FIG. 4A, a polygonal cylindrical member as shown in FIG. 4B or 4C, or a circular cylindrical member having a longitudinal slit as shown in FIG. 4D. These members may be longitudinally layered in two or more stages, in practice. Alternatively, the anode 2 may be constituted by layering a plurality of net-like members, as in shown in FIG. 5.

Further, as in shown in the conventional example of FIG. 2, an anode may be formed by vertically layering a plurality of plate-like members each being provided with a number of holes, on each other. In that case, the corresponding holes of the upper and lower plate-like members are positioned to be coaxial with each other.

In the sputter ion pump constructed based upon the second concept of the present invention, the gaps $G_1$ and $G_2$ between the respective cathodes 1 and the anode 2 are increased to be greater than those of a conventional sputter ion pump, by satisfying the relation $0.01<L/(G_1+G_2)<1$. Influences from the conductance of these gaps is small so that the effective exhaust speed is higher.

Figure 11:
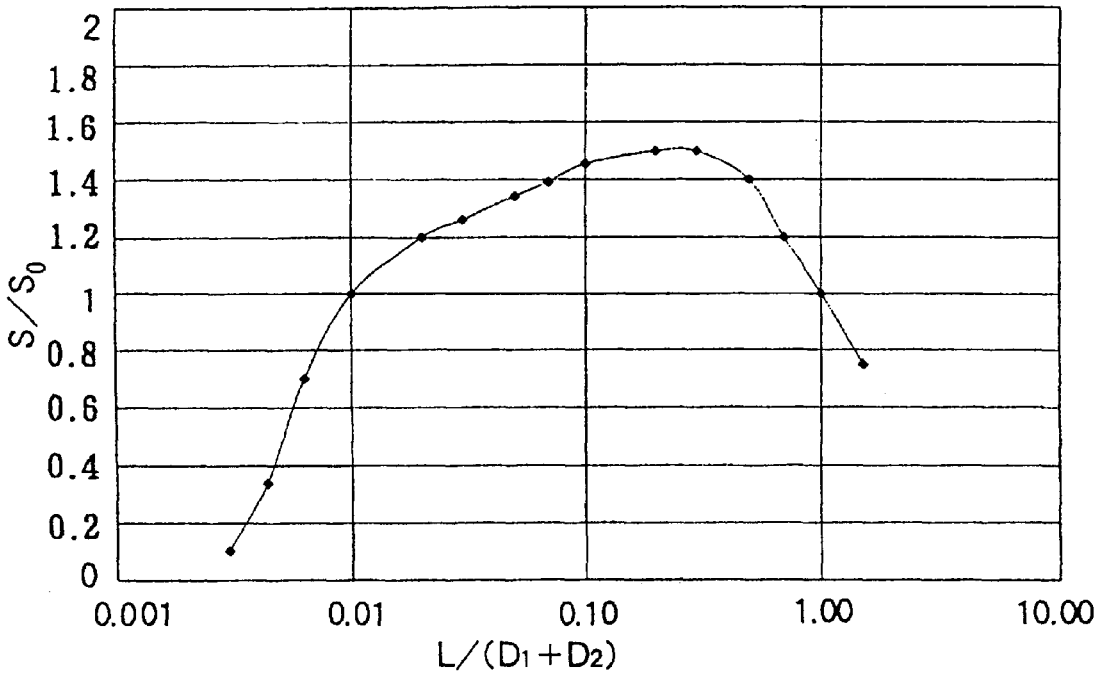
FIG. 11 is a graph showing an experiment example of the evacuation speed of the sputter ion pump constructed in accordance with the concept of the present invention of FIG. 10.

FIG. 11 shows an example of experimental results and how the exhaust speed changes in accordance with the relationship between the length of the anode and the distance between the cathode and the anode. The longitudinal axis of the figure represents a value obtained by dividing the exhaust speed S while the value of $L/(G_1+G_2)$ is changed, by the exhaust speed $S_o$ when $L=(G_1+G_2)$ is satisfied. The peak of $S/S_o$ can be shifted within a range of 0.01 to 1 of $L/(G_1+G_2)$, by appropriately setting the diameter of each of cylindrical members 2*a* constituting the anode 2 and the internal pressure.

The concept described with reference to FIG. 10 may be applied to a sputter ion pump of a different type, e.g., of a three-pole type.

In addition, since exhaustion is performed at a low pressure in the present invention, it is preferable to adopt an anode structure which has a strong magnetic field and holes each having a large diameter.

As described in the above, according to one aspect of the present invention, the cathodes and anode are arranged so as to satisfy the relation $0.015 \leqq L/D \leqq 0.8$, is provided between two cathodes. It is, therefore, possible to provide a sputter ion pump which can attain a higher critical vacuum level and an exhaustion speed which is twice higher than that of a conventional pump.

In addition, by using two or more layers, the number of cathodes (which are made of expensive material) can be reduced so that the manufacturing costs for the pump can be reduced.

According to the second aspect of the present invention, the cathodes and the anode are arranged so as to satisfy a relation $0.01<L/(G_1+G_2)<1$. Therefore, it is possible to obtain the effective exhaust speed twice higher than that of a conventional sputter ion pump.

We claim:

1. A sputter ion pump comprising at least one anode including a plurality of cell members and being disposed between two cathodes, wherein each said at least one anode and each of said cathodes are arranged to satisfy the following condition:

$$0.015 \leqq L/D \leqq 0.8$$

where L is a length of each said anode cell member and D is a diameter of each said anode cell member.

2. A sputter ion pump according to claim 1, comprising a number N of said anodes and a number n of said cathodes satisfying a relation of n=N+1.

3. A sputter ion pump according to claim 1, wherein front and back surfaces of a respective one of said two cathodes are subjected to sputtering.

4. A sputter ion pump according to claim 1, wherein said plurality of cell members is a plurality of parallel cylindrical members.

5. A sputter ion pump according to claim 1, wherein said plurality of cell members is a plurality of intermeshed members in a net-like arrangement.

6. A sputter ion pump according to claim 1, comprising two layered anodes, and said two cathode plates are disposed above and below each of said anodes, respectively.

7. A sputter ion pump comprising at least one anode including a plurality of cell members and disposed between a respective pair of cathodes, wherein each anode and each of said cathodes are arranged such that:

$$0.01<L/(G_1+G_2)<1$$

where L is a length of each said anode cell member, $G_1$ is a distance between one of said cathodes and said anode, and $G_2$ is a distance between the other said cathode and said anode.

8. A sputter ion pump according to claim 7, comprising a number N of said anodes and the number n of said cathodes satisfy a relation of n=N+1.

9. A sputter ion pump according to claim 7, wherein front and back surfaces of one of said cathodes are subjected to sputtering.

10. A sputter ion pump according to claim 7, wherein said plurality of cell members is a plurality of parallel cylindrical members.

11. A sputter ion pump according to claim 7, wherein said plurality of cell members is a plurality of intermeshed members in a net-like arrangement.

12. A sputter ion pump according to claim 7, comprising two layered anodes, and said cathode plates are disposed above and below each of said anodes, respectively.

* * * * *